United States Patent [19]

Kennington et al.

[11] 4,436,002

[45] Mar. 13, 1984

[54] REVERSAL MECHANISM FOR POWER TONG

[75] Inventors: Kerry S. Kennington; Ronald Baker, both of Austin, Tex.

[73] Assignee: Hughes Tool Company, Houston, Tex.

[21] Appl. No.: 329,971

[22] Filed: Dec. 11, 1981

[51] Int. Cl.[3] ..... B25B 17/00

[52] U.S. Cl. ..... 81/57.2; 294/114

[58] Field of Search ..... 81/57.2, 57.15; 294/114; 279/33

[56] References Cited

U.S. PATENT DOCUMENTS

| | | | |
|---|---|---|---|
| 1,811,666 | 6/1931 | Foster . | |
| 2,263,267 | 11/1941 | Franklin | 255/35 |
| 2,370,837 | 3/1945 | Boynton | 81/179 |
| 2,613,564 | 10/1952 | Walraven et al. | 279/33 |
| 2,657,014 | 10/1953 | Webster | 255/23 |
| 3,196,717 | 7/1965 | Sheppard | 81/57 |
| 3,610,640 | 10/1971 | Bollin et al. | 81/57.2 |
| 4,005,621 | 2/1977 | Turner et al. | 81/57.2 |
| 4,060,014 | 11/1977 | Turner | 81/57.2 |
| 4,170,908 | 10/1979 | Peveto et al. | 81/57.2 |
| 4,372,026 | 2/1983 | Mosing | 81/57.2 |

FOREIGN PATENT DOCUMENTS 1245288 7/1967 Fed. Rep. of Germany .

*Primary Examiner*—James L. Jones, Jr.

*Attorney, Agent, or Firm*—Robert A. Felsman; Charles D. Gunter, Jr.

[57] ABSTRACT

A power tong unit which is operable as a closed head or open head unit. The jaws of the tong unit are rotatable to an extended pipe gripping position from either of opposite directions to make-up or break-out pipe from a single retracted position. An improved reversal means controls the direction of rotation of the jaws between the make-up and break-out positions.

6 Claims, 15 Drawing Figures

REVERSAL MECHANISM FOR POWER TONG

CROSS-REFERENCE TO RELATED APPLICATIONS

This application is related to the application of James G. Renfro entitled "POWER TONG AND JAW APPARATUS", Ser. No. 06/329,972, filed Dec. 11, 1982.

BACKGROUND OF THE INVENTION

1. Field of the Invention

This invention relates in general to power tongs used for rotating casing, tubing and pipe in earth drilling and reaming operations and the like and, in particular, to power tongs with movable jaws that grip pipe to make-up and break-out threaded connections.

2. Description of the Prior Art

Power tongs associated with well drilling work are well known in the art. Such prior tongs have generally been classified as either open head or closed head tongs. A lateral passageway is provided in the open head tong which allows the pipe to be engaged or disengaged by moving the tong laterally with respect to the vertical pipe axis. The closed head tong, being formed in the shape of a closed circle, can only be installed on the pipe by lowering the tong over the pipe while the pipe is held by slips at the rig floor. The power tong shown in U.S. Pat. No. 1,811,666 to W. W. Foster, issued June 23, 1931, entitled "Automatic Power Driven Pipe Wrench" is a closed head tong. The closed head tong remains around the pipe for subsequent make-up and break-out operations and must be stripped over the pipe for removal.

In addition to the open head or closed head terminology, power tongs are also generally classified as unidirectional or bidirectional in operation depending on the jaw system employed. A unidirectional tong has jaws which close and grip pipe when the tong rotates in a single direction. If the tong is rotated in the opposite direction, the jaws are disengaged and retracted from the pipe gripping position. Bidirectional tongs have jaw systems which permit left hand or right hand rotation of the pipe being gripped, depending on the direction of rotation of the tong. Open head tongs exist which are bidirectional in operation, in some cases without reversing the jaw elements by hand or inverting the tong unit.

The power tong shown in U.S. Pat. No. 4,060,014 to John W. Turner, Jr., issued Nov. 29, 1977, entitled "Power Tong" is an open head tong which is bidirectional in operation without inverting the unit or manually reversing the jaw elements. Turner's device can also accommodate greater pipe diameters than did prior open head units. In spite of these advantages, Turner's device is shiftable between the make-up and break-out modes only when a pipe is not located within the tong head. Changing modes also requires the removal and reinsertion of a pin between holes in the tong head.

There exists a need for a power tong which will allow the direction of jaw rotation to be reversed while the tong is located on the pipe and which will allow the jaws to be moved to a single retracted position within the tong head to allow pipe to be tripped through the head.

SUMMARY OF THE INVENTION

Shown is a pipe gripping tong having a stationary housing with a central opening for receiving the pipe to be gripped. A ring gear is rotatably mounted in the housing for movement about the central opening. The stationary housing also supports a plurality of jaws which are movable between an extended position for gripping pipe in the central opening and a retracted position. The jaws are rotatably engaged by the ring gear. A drive means transmits rotary motion to the ring gear to extend and retract the jaws.

A carrier assembly is supported by the stationary housing. The carrier assembly comprises upper and lower plates which are spaced apart by a plurality of fixed pins. The jaws are mounted on the fixed pins and sandwiched between the plates but are freely rotatable with respect of the pins. The ring gear is supported on rollers circumferentially spaced about the central opening in the housing. The jaws have integral gear teeth which engage gear teeth on the inner periphery on the ring gear. Movement of the ring gear causes the jaws to rotate to an extended pipe gripping position in either of opposite directions from a fully retracted position. By providing alignable openings in the housing, ring gear, and carrier assembly, an open head structure results.

Improved jaws are shown for use in the improved power tong of the present invention. Each jaw has an upper and lower surface and a pivot axis about which the jaw rotates in either of opposite directions. The jaws each have a pair of symmetrical gripping surfaces which converge to an apex. Preferably, each of the gripping surfaces is formed in the shape of an Archimedian spiral. The integral gear teeth of each jaw are located on a cylindrical protrusion which is rigidly affixed to a selected one of the upper and lower surfaces. Each cylindrical protrusion has an opening aligned with the pivot axis of the jaw which is adapted to receive a selected one of the carrier assembly's fixed pins.

Reversal means are provided for controlling the direction of rotation of the jaws about the pins and include a detent pin mounted on the lower plate at a right angle with respect thereto. An upper extent of the pin is received within an opening in the ring gear. The opening in the ring gear is located at the approximate midpoint of two off-set, longitudinal slots in the ring gear. Positioning means are provided for shifting the detent pin between inner and outer radial positions in the opening of the ring gear whereby the detent pin upper extent travels in a selected one of said longitudinal slots when the ring gear is rotated.

Additional objects, features and advantages of the invention will become apparent in the following descriptions.

DETAILED DESCRIPTION OF THE INVENTION

Figure 1:
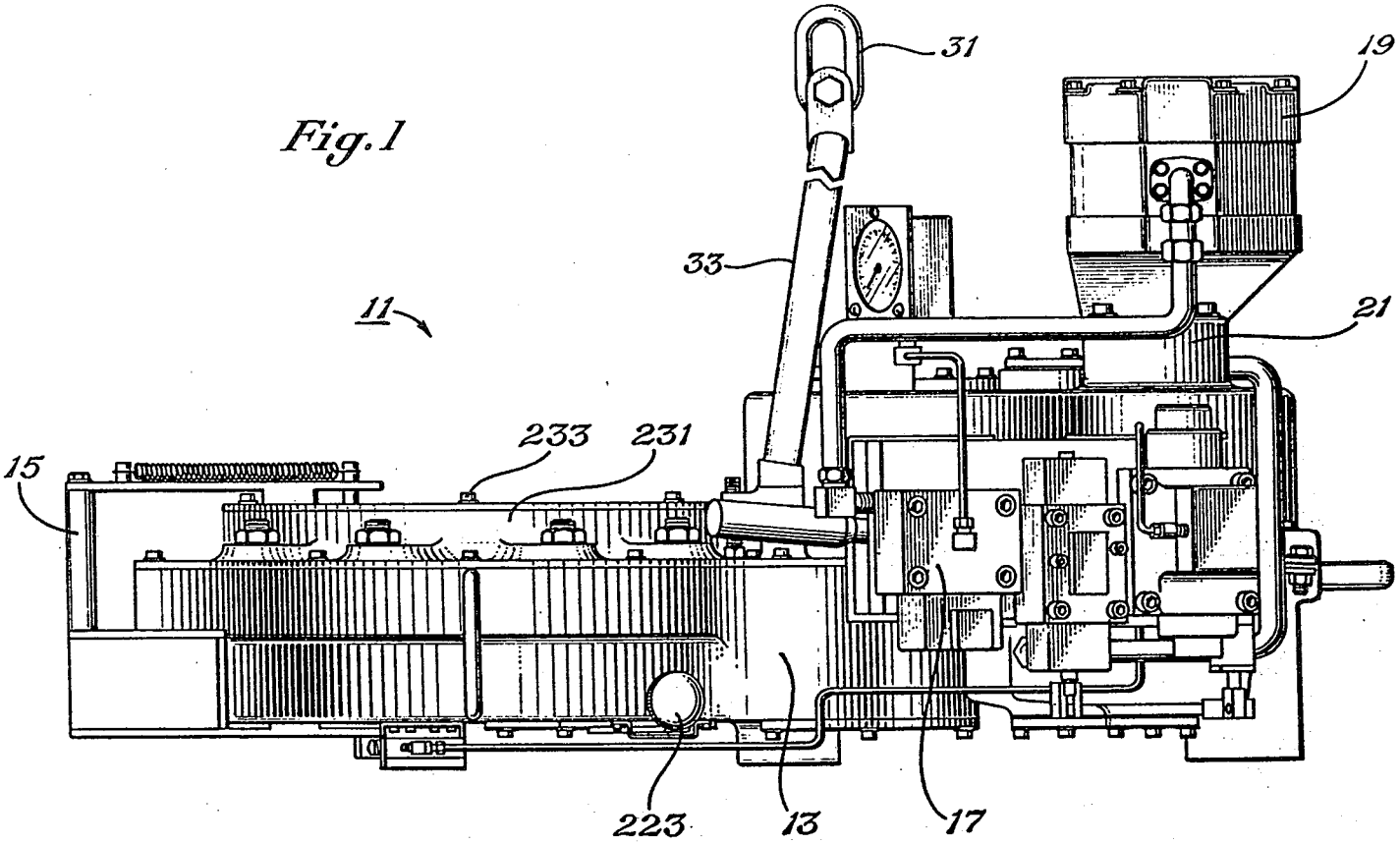
FIG. 1 is a side view of the power tong apparatus of the invention.

Referring now to FIG. 1, the improved power tong unit is designated generally as 11. The power tong unit 11 includes a stationary housing 13 having a gate arm 15 and a drive means 17 for transmitting rotary motion to the tong unit as will be presently described. The drive means 17 includes a drive motor 19 and a suitable gear reduction unit 21 rigidly secured to the stationary housing 13.

Figure 2:
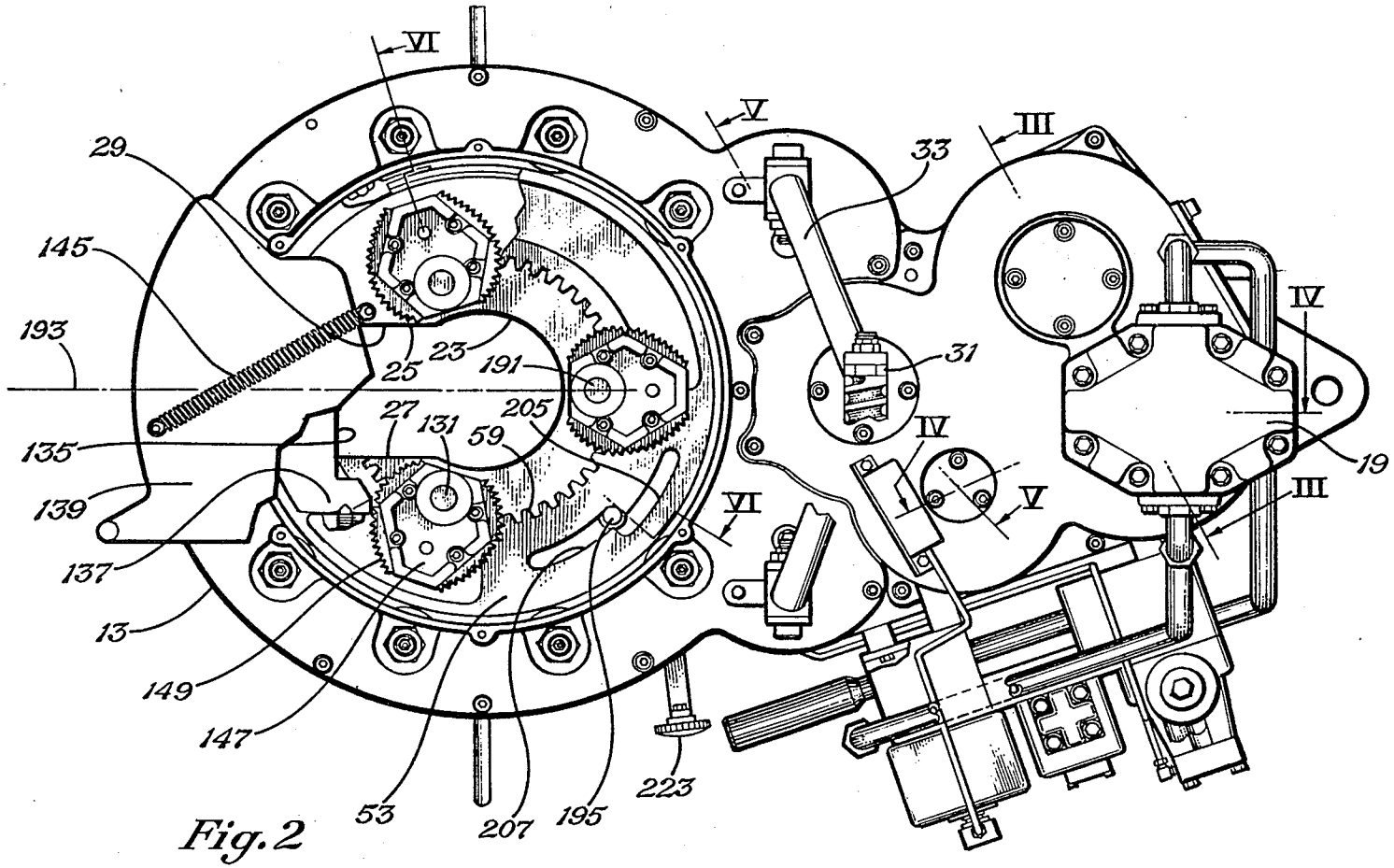
FIG. 2 is a top view of the power tong apparatus of FIG. 1 with portions of the tong head broken away.

As shown in FIG. 2, the stationary housing 13 has a semi-circular central opening 23 for receiving pipe to be gripped and a lateral passageway 25 extending outwardly from central opening 23 to the exterior of the housing. The walls 27, 29 of lateral passageway 25 are spaced-apart sufficiently to receive pipe, casing, or tubing of the desired diameter. Passageway 25 and central opening 23 together form a keyhole-shaped opening which allows the tong unit 11 to slide onto a vertically oriented pipe by lateral movement of the tong unit relative to the pipe. The housing 13 is supported on the drill rig in any suitable manner to provide such lateral movement, as by a wire line (not shown) connected to a link 31 of a bail 33.

Figure 6:
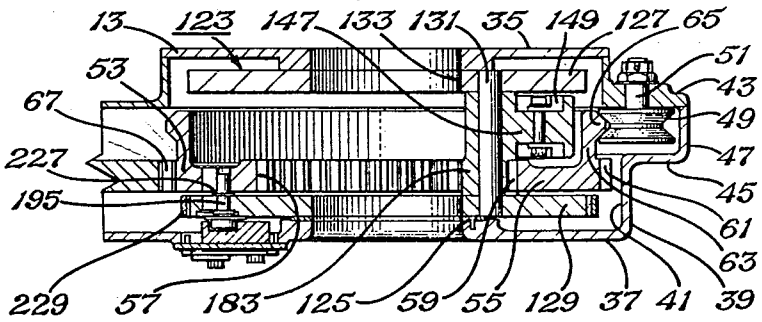
FIG. 6 is a cross-sectional view taken along lines VI—VI in FIG. 2.

As shown in FIGS. 2 and 6, housing 13 has upper and lower surface portions 35, 37, respectfully, separated by outer sidewalls 39. Upper and lower surface portions 35, 37 have formed therein the central opening 23 and lateral passageway 25 previously described and together with outer sidewalls 39 form a cavity 41 which is open about the entire periphery of central opening 23 and passageway 25. Sidewalls 39 extend outward from central cavity 41 to form an upper flange 43 and lower flange 45 joined by end wall 47.

A plurality of rollers 49 are journaled on shafts 51 which depend from upper flange 43 of housing 13. Rollers 49 are circumferentially spaced about central opening 23 in housing 13 and are adapted to receive and support a ring gear 53.

Figure 10:
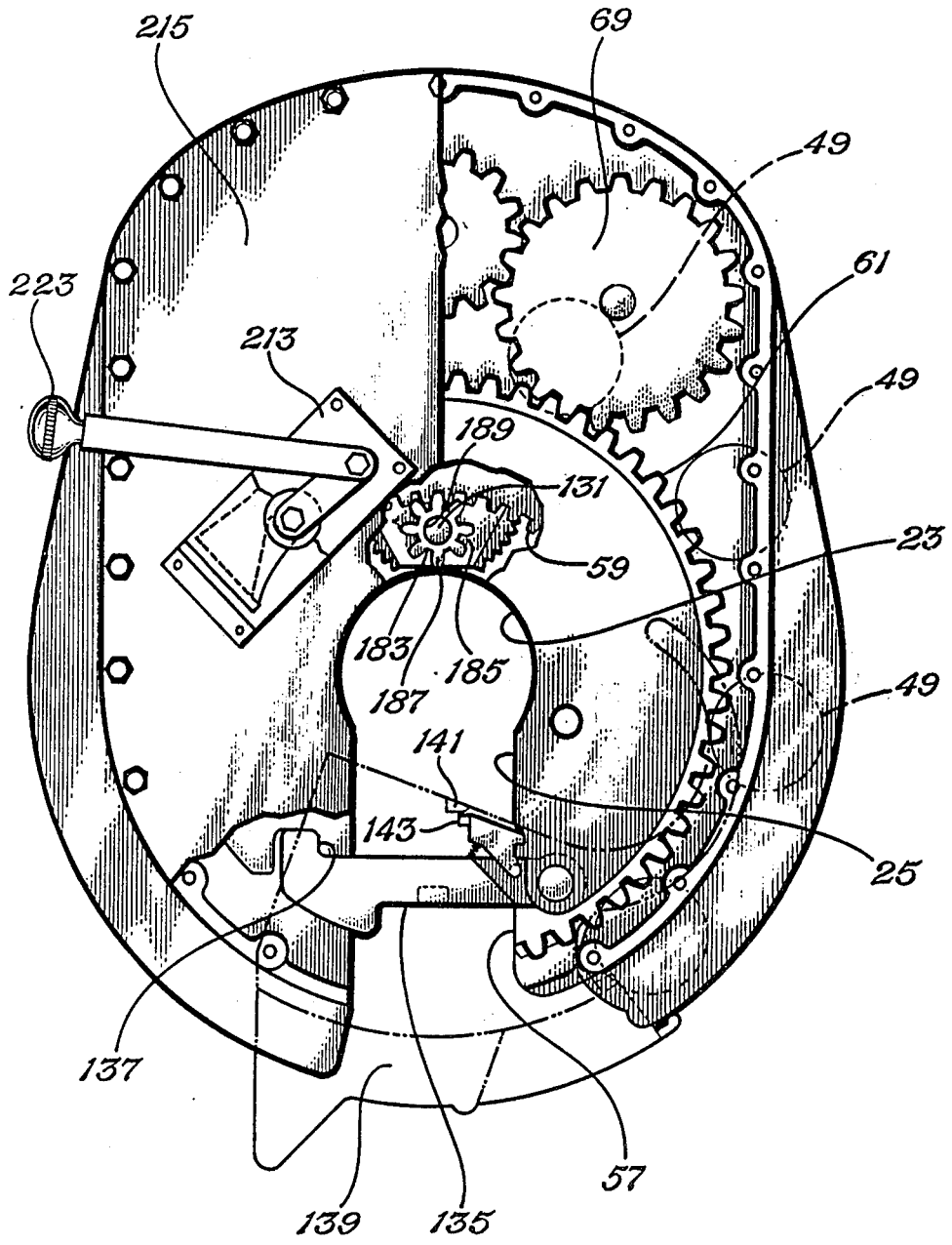
FIG. 10 is a bottom-view of the tong head of the power tong apparatus of FIG. 2 with portions broken away.

Ring gear 53 has a generally circular base portion 55 having an inwardly extending opening 57 (FIGS. 6 and 10) which opening is of the same configuration as lateral passageway 25. The sides of opening 57 in ring gear 53 are in vertical alignment with lateral passageway 25 when the tong is in the open position to permit a drill pipe to be received within opening 15. Ring gear 53 has internal gear teeth 59 on the inner periphery of base portion 55 and external gear teeth 61 on the outer periphery thereof (FIGS. 6 and 10). Ring gear 53 is rotatably mounted in housing 13 for movement about central opening 15 by means of an upwardly extending shoulder 63 having a roller surface 65 which is received by rollers 49.

Figure 5:
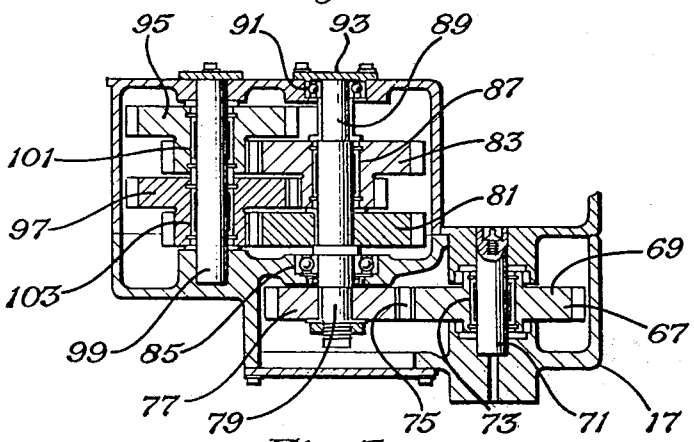
FIG. 5 is a cross-sectional view taken along lines V—V in FIG. 2.

The external gear teeth 61 on the outer periphery of ring gear 53 mesh with the gear teeth 67 of a pair of identical idler gears 69 (FIGS. 5 and 10) mounted on shafts 71 and roller bearings 73. Idler gears 69 have teeth 75 which mesh with the gear teeth of a lower output gear 77 mounted on a drive shaft 79 which also has mounted thereon an upper output gear 81 and cluster gears 83. A ball bearing race 85 separates output gears 77 and 81. Cluster gears 83 are rotatably mounted on shaft 79 by means of roller bearings 87. The upper end 89 of shaft 79 is received within a ball bearing race 91 which is held in place by a drive shaft cover plate 93.

Figure 4:
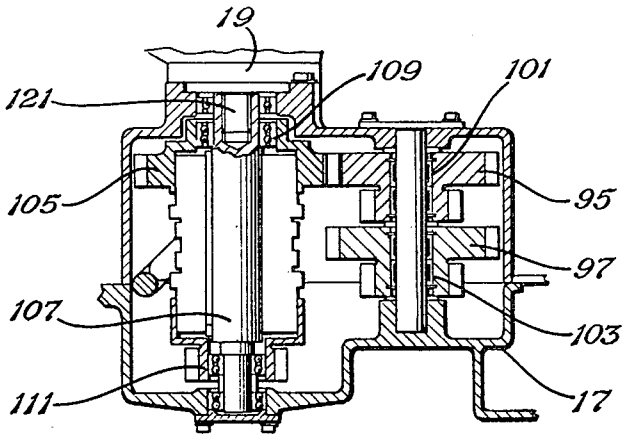
FIG. 4 is a cross-sectional view taken along lines IV–IV in FIG. 2.
Figure 3:
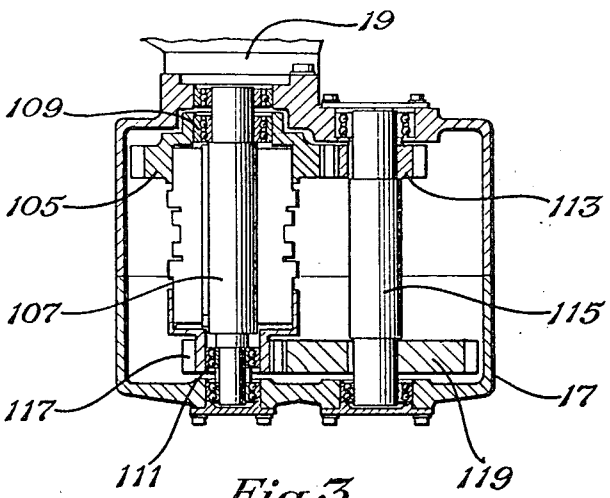
FIG. 3 is a cross-sectional view taken along lines III—III in FIG. 2.

Upper output gear 81 and cluster gears 83 on drive shaft 79 mesh with a set of upper and lower cluster gears 95, 97 rotatably mounted on a transmission shaft 99 by roller bearings 101,103. Cluster gears 95, 97 on transmission shaft 99, as shown in FIG. 4, mesh with a clutch gear 105 located on a clutch shaft 107 which is mounted within stationary housing 13 by bearing assemblies 109, 111. As shown in FIG. 3, clutch gear 105 meshes with a pinion gear 113 on a jack shaft 115. A lower clutch gear 117 on clutch shaft 107 meshes with a low speed gear 119 rotatably mounted on the end of jack shaft 115 opposite pinion gear 113.

Clutch shaft 107 is driven by the motor drive shaft 121 of drive motor 19. Drive motor 19 can be any suitable reversible drive means or motor such as a suitable electric, pneumatic, or hydraulic motor. Preferably, motor 19 is hydraulically powered. Such drive motors as well as the reduction units and gear trains of the type described above used to power ring gear 53 are commonly used in the power tong industry and further description thereof is not necessary to the understanding of the present invention to those skilled in the power tong art.

A carrier assembly, designated as 123 in FIG. 6 is supported by stationary housing 13 on a wear surface 125 and includes an upper plate 127 and a lower plate 129 spaced-apart by a plurality of fixed pins 131. Plates 127, 129 are provided with an inwardly extending opening 133 which corresponds to and is alignable with opening 57 in ring gear 53. An inner gate 135, as shown in FIGS. 2 and 10, spans the inwardly extending opening in plates 127, 129 when the tong unit is in operation.

The tong gate mechanism shown in FIGS. 2 and 10 consists of two portions. The inner gate 135 ties the upper and lower plates 127, 129 together when closed and is held in place by a latch 137 that catches lower plate 129. An outer gate 139 covers the openings in stationary housing 13 that would expose any moving parts of the device during operation. The inner gate 135 thus connects the openings in upper and lower plates 127, 129 and rotates with the plates when the closed position. When the openings 57 in plates 127, 129, are aligned with lateral passageway 25 in stationary housing 23, the inner and outer gates 135, 139 can be opened by either the force of the drill pipe being moved laterally against the inner gate 135, or by hand. When outer gate 139 is opened, a tab 141 catches a tab 143 on the inner gate latch 137, allowing the two gates to move together.

An over-center spring 145 (FIG. 2) on outer gate 139 aids in opening and closing the gates.

Figure 7:
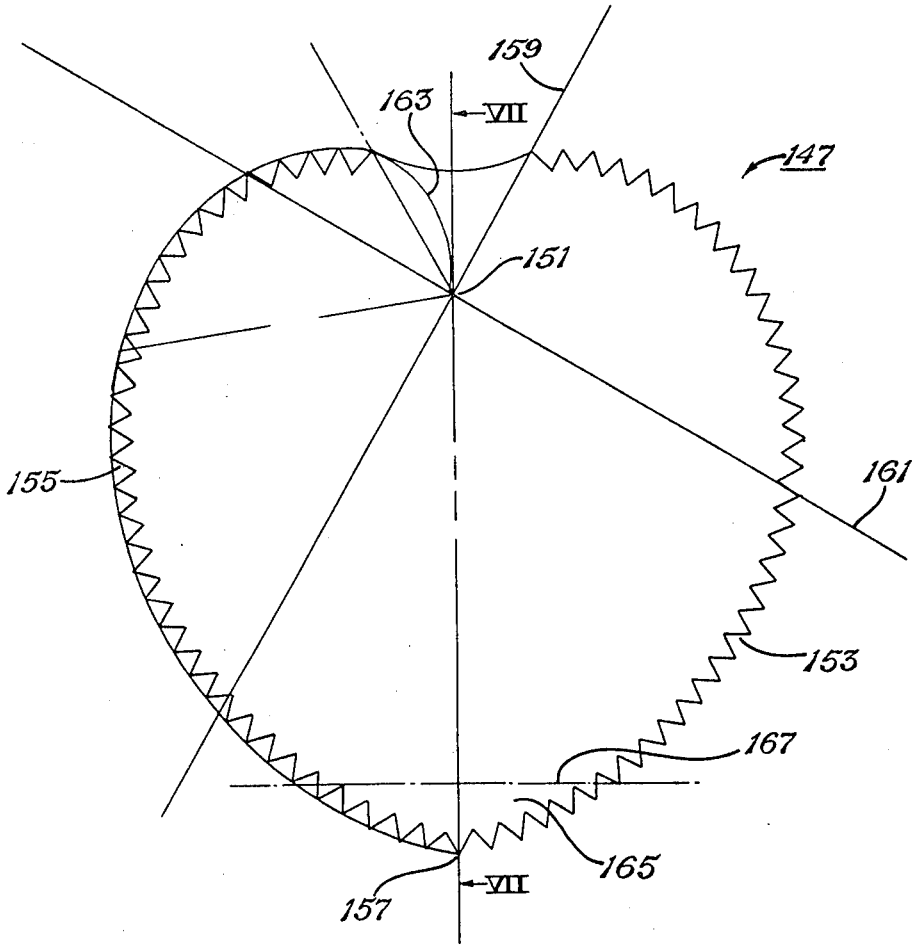
FIG. 7 is a simplified schematic view illustrating the design of the tong jaws used in the power tong apparatus of FIG. 2.

A plurality of jaws 147 (FIGS. 2 and 6) having replaceable dies 149 are mounted on pins 131 between plates 127, 129 and are freely rotatable with respect to pins 131. As shown in FIG. 7, each jaw 147 has a pivot axis 151 about which the jaw rotates in either of opposite directions. A pair of symmetrical gripping surfaces 153, 155 converge toward an apex 157 spaced outermost from the pivot axis 151. Preferably, each of the gripping surfaces 153, 155 is formed in the shape of an Archimedian spiral having as its point of origin the pivot axis 151. That is, if an imaginary axis 159, 161 is drawn through the pivot axis 151 and a plot is made of the equation:

$$r=a\theta$$

where $\theta$ is in radians and "a" is a constant, the result is an Archimedian spiral 163. A mirror image of section VII—VII drawn through the origin 151 and encompassing the useful segment of the spiral 163 completes the jaw. The tip portion 165 of jaw 147 represented by that portion of the jaw forward of line 167 in FIG. 7 can be omitted if desired as shown in FIG. 2, as this portion of the jaw never contacts the pipe in practice.

Figure 8:
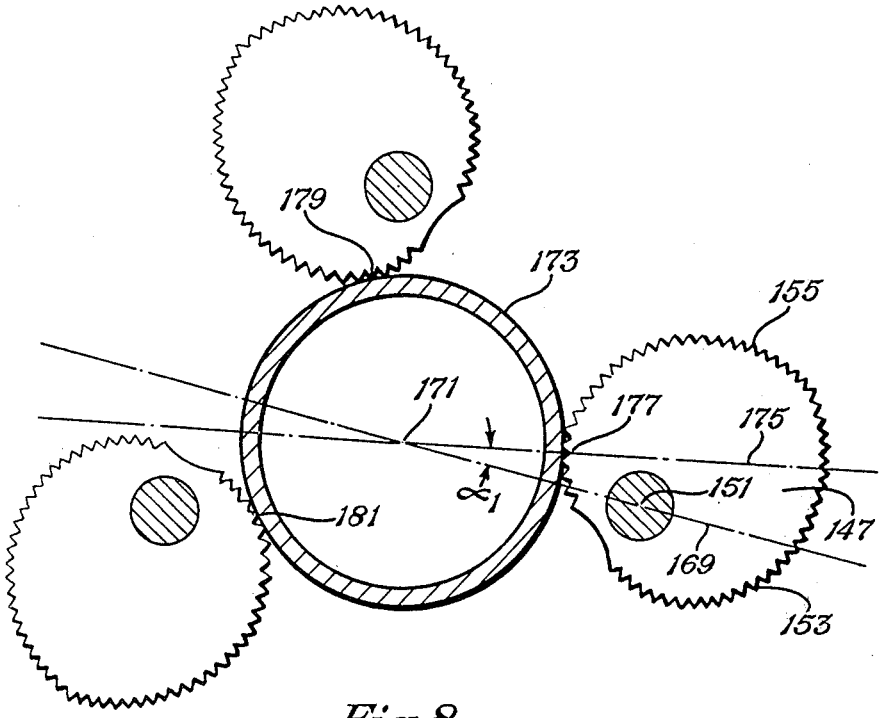
FIG. 8 is a simplified schematic view of the operation of the tong jaws of the power tong apparatus of FIG. 2 shown gripping large diameter pipe.
Figure 9:
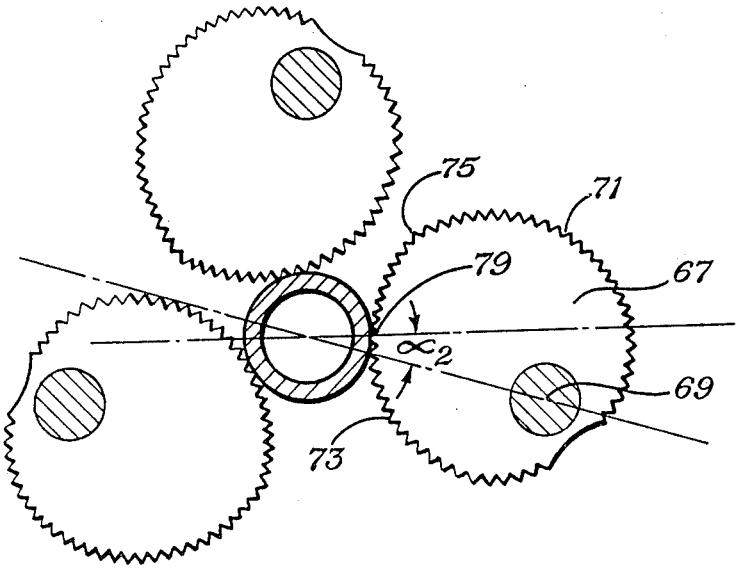
FIG. 9 is similar to FIG. 8 but shows the tong jaws gripping small diameter pipe.

As shown in FIGS. 8 and 9, for a given diameter pipe, the cam angle is determined by first drawing a line 169 which intersects the vertical axis 171 of the pipe 173 being gripped and the pivot axis 151 of the jaw 147. A second line 175 is then drawn from vertical axis 171 of pipe 173 through the point 177 at which the jaw 147 cams or first contacts the exterior surface of the pipe 173. The included angle, $\alpha_1$, is the "cam angle". By forming the gripping surfaces 153, 155, of the jaw 147 in the shape of an Archimedian spiral, a wide range of pipe diameters can be gripped with the cam angle remaining constant. Thus in FIGS. 8 and 9, $\alpha_1$, will be approximately equal to $\alpha_2$ despite the difference in pipe diameter being gripped. The fact that there are three points of contact 177, 179, 181 between similar synchronized surfaces of the jaws 147 and the pipe exterior 173 centers the pipe within the central opening (23 in FIG. 2) of the tong head. A constant cam angle keeps the forces exerted on each pipe size proportional to pipe diameter and torque.

As shown in FIGS. 6 and 10, a cylindrical protrusion 183 is rigidly affixed to the lower surface 185 of jaw 147. Cylindrical protrusion 183 has integral gear teeth 187 about its outer periphery which mesh with the internal gear teeth 59 of ring gear 53. Cylindrical protrusion 183 also has an opening 189 aligned with the pivot axis 151 of the jaw 147, adapted to receive a selected one of fixed pins 131.

As shown in FIGS. 2 and 6, pins 131 are transversely aligned between plates 127, 129 and circumferentially spaced about central opening 23 in housing 13. There are preferably three pins 131 and corresponding jaws 147 having pivot axes spaced at 120 degree intervals about a vertical axis drawn through the central opening 23. As is known in the art, other jaws spacings can be used if desired or an increased number of jaws with appropriate circumferential spacing can be employed. In the preferred arrangement, one jaw has a pivot axis 191, (FIG. 2), which lies along a center line 193 drawn mid-way between walls 27, 29 of lateral passageway 25 in the horizontal plane. The pivot axes of the other two jaws are then spaced 120 degrees from pivot axis 191 in opposite arcuate directions on a given diameter circle concentric with axis 191. The radius of the circle used to locate the pivot axis of jaws 147 is selected to allow each of the jaws 147 to rotate in a 360 degree arc about its pivot axis within the carrier assembly 123 without coming into contact with the upwardly extending shoulders 63 of ring gear 53 (see FIG. 6). The jaws 147 thus have full radial clearance within the carrier assembly 123 once it is in place in stationary housing 13.

Figure 14:
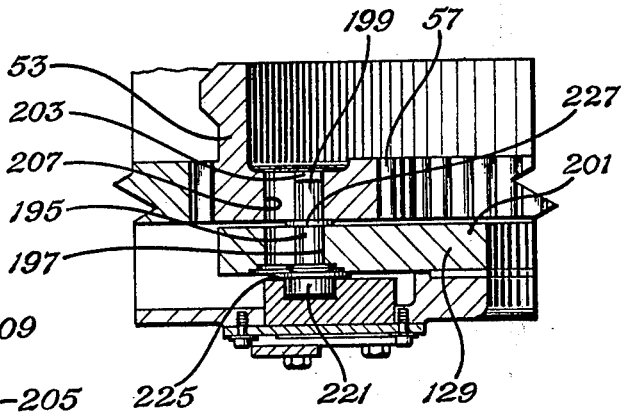
FIG. 14 is a side-fragmentary view similar to FIG. 6 showing the operation of the detent pin of power tong apparatus.
Figure 13:
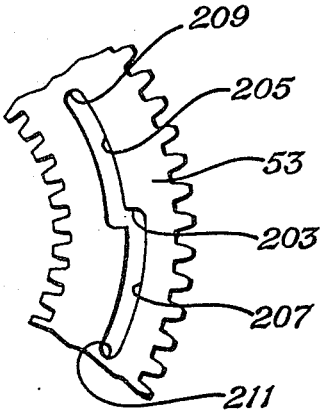
FIG. 13 is a close-up fragmented view of the longitudinal slots in the ring gear of the power tong apparatus.

A reversal means is provided for controlling the direction of rotation of jaws 147 about pins 131. The reversal means includes a detent pin 195 (FIGS. 6 and 14) mounted within an opening 197 in lower plate 129 (FIG. 14) and having an upper extent 199 which extends at a generally right angle from the upper surface 201 of plate 129. Ring gear 53, as shown in FIGS. 6 and 13, has a transverse opening 203 located at the approximate mid-point of two longitudinal, off-set, slots 205, 207 in ring gear 53. By shifting detent pin 195 between inner and outer radial positions in opening 197 in plate 129 and similarly in opening 203 in ring gear 53, detent pin 195 is allowed to travel in a selected one of the longitudinal slots 205, 207 in ring gear 53 when ring gear 53 is rotated. End portions 209, 211 in slots 205, 207 serve as "stops" for detent pin 195 as it travels in slots 205, 207.

Figure 11:
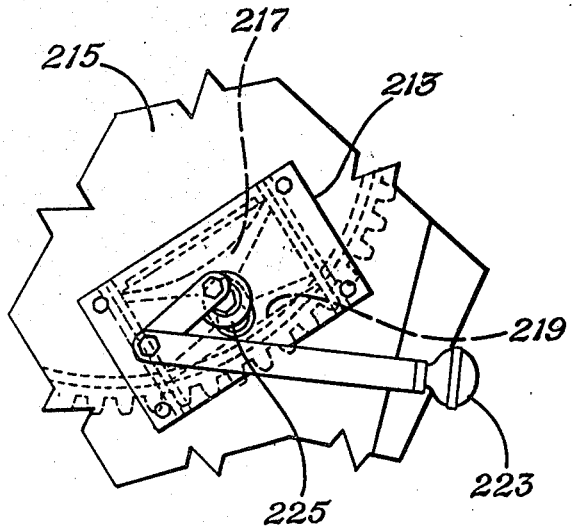
FIG. 11 is a close-up view of the shifting block of the power tong apparatus in FIG. 10.
Figure 12:
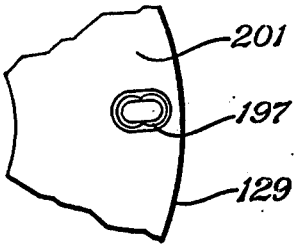
FIG. 12 is a close-up fragmented view of the opening in the bottom plate of the carrier assembly of the power tong apparatus.
Figure 15:
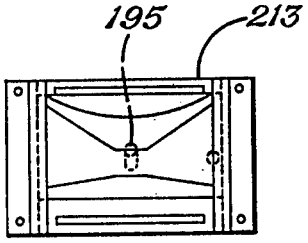
FIG. 15 is a close-up fragmentary view of the shifting block similar to FIG. 11 showing the movement of the detent pin.

Positioning means, including a shifting block 213 (FIGS. 11 and 15) contained within the bottom exterior 215 of housing 13 is provided for shifting the detent pin 195 radially inwardly and outwardly within opening 197 and 203. Shifting block 213 has double camming surfaces 217, 219 which converge to a central opening 120 of constant width. Camming surfaces 217, 219, contact the lower extent 221 of detent pin 195 as the ring gear 53 and carrier assemby 123 are rotated within housing 13. The position of the shifting block 213 is manually controlled by the operator through movement of a positioning arm 223. Movement of the positioning arm 223 causes the shifting block 213 to slide radially toward and away from central opening 23 of the tong head. By properly positioning shifting block 213, the detent pin 195 can be shifted radially inwardly and outwardly within opening 197 in lower plate 129, thereby allowing upper extent 199 of detent point 195 to travel in a selected one of longitudinal slots 205, 207, in ring gear 53. Spring washers 225, 227 retain detent pin 195 in opening 197 and cause pin 195 to spring into one of two radial positions in opening 197.

The longitudinal slot 205, 207 in ring gear 53 in which detent pin 195 travels determines the direction of jaw rotation in the tong unit. The position of the detent pin 195 is, in turn, determined by the position of the shifting block 213. As the ring gear 53 rotation is reversed, the shifting block 213 can be moved radially in or out with respect to central opening 23 of the tong unit and when in position, detent pin 195 will strike the appropriate camming surface 217, 219 of the shifting block 213 as it passes, causing the detect pin 195 to move radially in the opening 197. The upper extent 199 of pin 195 also moves radially in the corresponding opening 203 in ring gear 53 to allow travel in one of the longitudinal slots 205, 207. Travel of pin 195 in a select one of slots 205, 207 allows relative motion between the ring gear 53 and lower plate 129 to cause initial jaw rotation as will be described more fully later. A reverse ring gear 53 rotation of approximately 15 degrees puts the detent pin 195 into alignment with opening 203 in ring gear 53. In this position, the jaws 147 are fully retracted in the tong head and only in this position can the detent pin 195 be shifted in opening 203 to allow jaw reversal.

A brake band 229 is mounted in stationary housing 13 about the outer periphery of lower plate 129, as shown in FIG. 6, and contacts the exterior surface of lower plate 129 to create drag on the lower plate 129 as the ring gear 53 rotates. This drag between the ring gear 53 and carrier assembly 123 causes jaw rotation from the retracted to the jaw gripping position as will be described. Brake band 229 has an opening in the circumference which corresponds to the piper receiving lateral passageway 25 in the tong head.

A cover plate 231 (FIG. 1) can be secured to housing 13 as by bolts 233 to provide greater operator safety while allowing access to the moving parts of the tong for servicing as required.

The operation of the improved power tong will now be described in greater detail. Beginning with gates 135, 139 fully open, the power tong receives a pipe through lateral passageway 25 in housing 13, inwardly extending opening 57 in ring gear 53, and corresponding aligned openings in plates 127, 129 of carrier assembly 123. As the pipe enters central opening 23, gates 135, 139 close. By positioning the camming surfaces 217, 219 in shifting block 213, detent pin 195 has been shifted in slot 197 in plate 129 to allow travel in longitudinal slot 205 of ring gear 53. The operator then engages the drive motor which ultimately powers output gear 77 and idler gears 69. Idler gears 69 in turn mesh with external gear teeth 61 on the generally circular portion of ring gear 53 causing ring gear 53 to rotate in a clockwise direction about central opening 23 with roller surfaces 65 riding on rollers 49.

The internal gear teeth 59 on the inner periphery of ring gear 53 mesh with the integral gear teeth 187 on jaws 147 in in carrier assembly 123. The frictional resistance of brake band 229 on lower plate 129 momentarily holds back rotation of the carrier assembly 123 causing the jaws 147 to rotate from a retracted position outward in a clockwise fashion into central opening 23 to a pipe gripping position. At the point at which the jaws 147 engage the pipe, relative motion of the jaws 147 about fixed pins 131 ceases. The continued rotation of ring gear 53 overcomes the frictional resistance of brake band 229 on lower plate 129 causing the carrier assembly 123 as a whole to rotate about central opening 23 in a clockwise direction.

Reverse rotation of the drive motor by the operator causes the jaws 147 to rotate in the opposite direction away from the pipe gripping position until detent pin 195 travels to the end of longitudinal slot 205 adjacent opening 203. The jaws are then held in the fully retracted position with the apex of the jaws pointed 180 degrees away from the vertical axis of central opening 23.

To reverse the camming action of the jaws 147 and switch from the make-up to the break-out mode, the shifting block 213 is positioned to shift detent pin 195 to the opposite extent of transverse slot 203 allowing travel in longitudinal slot 207. The jaws are then free to rotate 180 degrees in a counterclockwise direction from the retracted position to a pipe gripping position for breaking-out joints of pipe. The present arrangement thus allows the jaws to rotate up to 180 degrees in either of opposite directions or until contact is made with a pipe to make-up or break-out pipe from a single fully retracted position, regardless of whether central opening 23 is empty or occupied by a pipe.

An invention has been provided with significant advantages. The power tong unit of the prevent invention is fully reversible on or off the pipe. The central opening 23 in the housing 13 is large enough to trip pipe with the tong in position about the pipe string. With the jaws in the fully retracted position, the tong unit 11 can be moved laterally on or off the pipe or the pipe can be run through the vertical axis of opening 23. The power tong can thus function as either an open head or closed head tong.

The improved jaws for use in the tong unit 11 allow a wider range of diameter of pipe to be gripped without problems of eccentricity. By forming the gripping surfaces in the shape of an Archimedian spiral, a constant cam angle is achieved over a wide range of pipe diameters.

While the invention has been shown in only one of its forms, it should be apparent to those skilled in the art that it is not thus limited but is susceptible to various changes and modifications without departing from the spirit thereof.

We claim:

1. In a pipe gripping tong of the type having a stationary housing with a central opening for receiving pipe to be gripped, a ring gear rotatably mounted in said housing for movement about said central opening, a plurality of jaws supported by said housing and movable between an extended position for gripping pipe in said central opening and retracted position, said jaws being rotatably engaged by said ring gear, and drive means for transmitting rotary motion to said ring gear, wherein the improvement comprises:

a carrier assembly supported by said housing for rotation about said central opening, said assembly comprising upper and lower plates spaced apart by a plurality of pins, said jaws being mounted on said pins between said plates; and said jaws being rotatable to said extended pipe gripping position in either of opposite directions from a single retracted position;

reversal means for controlling the direction of rotation of said jaws; and wherein said reversal means comprises a detent pin mounted on said lower plate at a right angle with respect thereto, one end of said pin being received within a transverse opening in said ring gear, said opening on said ring gear being located at the approximate mid point of two, off-set, longitudinal slots in said ring gear.

2. The pipe gripping tong of claim 1, further comprising:

positioning means for shifting said detent pin between inner and outer radial positions in said opening in said lower plate whereby said detent pin end travels in a selected one of said longitudinal slots when said ring gear is rotated.

3. The pipe gripping tong of claim 2, wherein said positioning means is a shifting block having double camming surfaces adapted to contact said detent pin to position said pin within said opening.

4. In a pipe gripping tone of the type having a stationary housing with a central opening for receiving pipe to be gripped, a ring gear rotatably mounted in said housing for movement about said central opening, a plurality of jaws supported by said housing and movable between an extended position for gripping pipe in said central opening and a retracted position, said jaws being rotatably engaged by said ring gear, and drive means for transmitting rotary motion to said ring gear, wherein the improvement comprises:

a carrier assembly supported by said housing for rotation about said central opening, said assembly comprising upper and lower plates spaced apart by a plurality of fixed pins, said jaws being mounted on said pins between said plates;

said ring gear having internal gear teeth on the inner periphery thereof and said jaws having integral gear teeth engageable with the internal gear teeth on the inner periphery of said ring gear; and said jaws being rotatable to said extended pipe gripping position in either of opposite directions from a single retracted position;

reversal means for controlling the direction of rotation of said jaws; and wherein said reversal means comprises a detent pin mounted on said lower plate at a right angle with respect thereto, one end of said pin being received within a transverse opening in said ring gear, said opening on said ring gear being located at the approximate mid point of two, off-set, longitudinal slots in said ring gear.

5. The pipe gripping tong of claim 4, further comprising:

positioning means for shifting said detent pin between inner and outer radial positions in said opening in said lower plate whereby said detent pin end travels in a selected one of said longitudinal slots when said ring gear is rotated.

6. The pipe gripping tong of claim 5, wherein said positioning means is a shifting block having double camming surfaces adapted to contact said detent pin to position said pin within said opening.

* * * * *